United States Patent [19]

Gary

[11] Patent Number: 4,986,504

[45] **Date of Patent: * Jan. 22, 1991**

[54] DECORATIVE LIGHT PEDESTAL WITH HINGED CLOSURE

[75] Inventor: Lonnie F. Gary, Lubbock, Tex.

[73] Assignee: Gary Products Group, Inc., Lubbock, Tex.

[ * ] Notice: The portion of the term of this patent subsequent to Oct. 31, 2006 has been disclaimed.

[21] Appl. No.: 430,804

[22] Filed: Nov. 2, 1989

Related U.S. Application Data

[63] Continuation-in-part of Ser. No. 294,268, Jan. 6, 1989, Pat. No. 4,877,209.

[51] Int. Cl.[5] ..... A47F 5/00

[52] U.S. Cl. ..... 248/205.3; 248/316.1; 362/249

[58] Field of Search ..... 248/205.3, 205.4, 314, 248/231.8, 316.7, 316.8, 254; 362/249, 457, 250, 430

[56] References Cited

U.S. PATENT DOCUMENTS

| | | | |
|---|---|---|---|
| 1,533,209 | 4/1925 | Radu | 248/314 X |
| 2,599,303 | 6/1952 | Ward | 248/231.8 X |
| 2,889,451 | 6/1959 | Longo | 248/314 |
| 3,189,310 | 6/1965 | Trueson | 248/314 |
| 3,193,229 | 7/1965 | Stock | 248/231.8 X |
| 3,219,812 | 11/1965 | Turner | 248/314 X |
| 3,504,169 | 3/1970 | Freeburger | 362/249 |
| 3,692,993 | 9/1972 | Robinson | 362/249 X |
| 3,713,614 | 1/1973 | Taylor | 248/205.3 X |
| 4,667,276 | 5/1987 | Cheng | 362/249 |
| 4,763,232 | 8/1988 | Woodside | 362/249 |
| 4,777,573 | 10/1988 | Liao | 362/249 |
| 4,779,177 | 10/1988 | Ahroni | 362/249 X |
| 4,877,209 | 10/1989 | Gary | 248/205.3 |
| 4,901,960 | 2/1990 | Gary | 248/205.3 |

*Primary Examiner*—Ramon O. Ramirez

*Attorney, Agent, or Firm*—Ross, Howison, Clapp & Korn

[57] ABSTRACT

A decorative light pedestal is provided that comprises a split base member, a circumferential support member extending outwardly from the base member and having an axial bore adapted to receive and maintain at least the socket portion of a decorative bulb and socket assembly therein, and a cover member adapted to releasably engage the base member for the purpose of adhesively securing the decorative light pedestal having a circumferential support member at least longitudinally coextensive with the overall length of a decorative bulb and socket assembly is also disclosed.

7 Claims, 2 Drawing Sheets

DECORATIVE LIGHT PEDESTAL WITH HINGED CLOSURE

CROSS-REFERENCE TO RELATED APPLICATION

This application is a continuation-in-part of U.S. patent application Ser. No. 07/294,268, filed Jan. 6, 1981 issued as U.S. Pat. No. 4,998,209, on Oct. 31, 1989.

BACKGROUND OF THE INVENTION

1. Field of the Invention

This invention relates to decorative lighting, and more particularly, to apparatus for supporting and maintaining decorative lighting on a substantially planar surface. One aspect of the invention relates to a decorative light pedestal adapted to receive and support at least the socket portion of a decorative bulb and socket assembly connected to a decorative light string. Another aspect of the invention relates to a decorative light pedestal having a closure adapted to maintain a decorative socket or decorative bulb and socket assembly inside the pedestal mount, and being releasable to remove the decorative socket or decorative bulb and socket assembly from the pedestal mount without disengaging the closure from a support surface to which it is attached.

2. Background Art

The use of ornamental lighting in decorating for holidays and other special occasions is well-known. Ornamental lighting is also useful in marketing displays and for creating special effects in commercial establishments. Strings of decorative lights comprising, for example, twenty-five, fifty or one hundred individual sockets are typically wired together with strands of insulated, small-diameter wire to which a plug or plugs are attached at one or both ends to facilitate connection to an electrical energy source to another strand of lights. Clear or colored bulbs are inserted into the sockets to provide the desired lighting effect.

Problems have been encountered where the desired decorative lighting scheme requires the attachment of decorative light strings to a substantially planar support surface. Some have previously sought to overcome this problem by adapting decorative light holders to be maintained on a substantially planar support surface by screw-type fasteners, nails, or the like. Such holders can damage the support surface and may not be adapted to maintain the decorative bulb and socket assemblies in a preferred alignment with respect to the support surface.

In U.S. Pat. No. 4,877,209, Applicant has previously disclosed a decorative light pedestal comprising a base member having a substantially planar mounting surface, a circumferential socket support member extending outwardly from the base member opposite the mounting surface, and an adhesive means adapted to bond the mounting surface of the pedestal to a support surface. With the decorative light pedestal disclosed in that patent, however, it is necessary to completely disengage the decorative light pedestal from the underlying support surface in order to remove the decorative bulb and socket assembly. Where the decorative light pedestal is secured to the support surface by means of an adhesive pad, disengaging the light pedestal for the purpose of removing the decorative bulb and socket assembly to change a bulb, for example, has necessitated replacing the adhesive pad in order to reattach the decorative light pedestal to the support surface. Accordingly, a decorative light pedestal is needed that is adapted in such manner that the decorative bulb and socket assembly can be removed therefrom without completely disengaging the decorative light pedestal from the support surface and thereby requiring replacement of the adhesive means.

SUMMARY OF THE INVENTION

According to one preferred embodiment the present invention, a decorative light pedestal is provided that comprises a releasable cover, the outwardly facing surface of which has a substantially planar mounting surface. According to a particularly preferred embodiment of the invention, an adhesive means such as a polymeric foam pad impregnated with a conventional, commercially available adhesive is secured to the outwardly facing surface of the cover member of the pedestal as previously disclosed in U.S. Pat. No. 4,877,209.

According to one preferred embodiment of the invention, the cover member is attached to the base member of the decorative light pedestal by a hinge, and a closure member is disposed opposite the hinge to releasably secure cover member to the base member of the pedestal mount.

According to another preferred embodiment of the invention, releasable closure members are provided on each side of the base member for releasably attaching the base member of the decorative light pedestal to the cover member, which is in turn adhesively attached to the support surface.

According to another embodiment of the invention, a decorative light pedestal is provided that comprises a base member having spaced apart sections which cooperate to define the plane of a mounting surface, a circumferential socket support member extending outwardly from the base member on the side of the base member that is opposite the mounting surface that is at least coextensive with the longitudinal extension of a decorative bulb and socket assembly inserted therein, and further comprising a first void extending axially through the circumferential support member and the plane of the base member to permit the decorative bulb and socket assembly to be inserted into the circumferential support member through the base member, and a second void adapted to receive and accommodate the passage of wiring connected to the socket assembly through the circumferential support member after the decorative bulb and socket assembly is inserted therein.

BRIEF DESCRIPTION OF THE DRAWINGS

The decorative light pedestal of the invention is further described in relation to the following figures of the Drawings wherein.

Like reference numerals are used to indicate like parts in all figures of the drawings.

DESCRIPTION OF THE PREFERRED EMBODIMENTS

Figure 1:
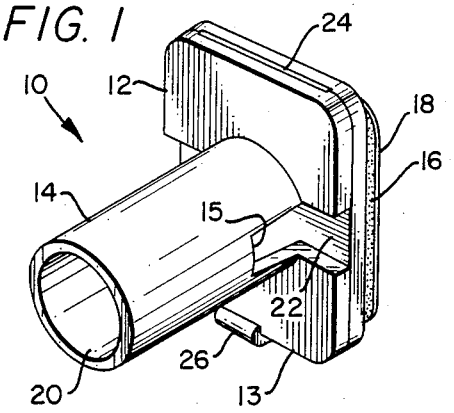
FIG. 1 is a perspective view of the decorative light pedestal and cover member of the invention.
Figure 2:
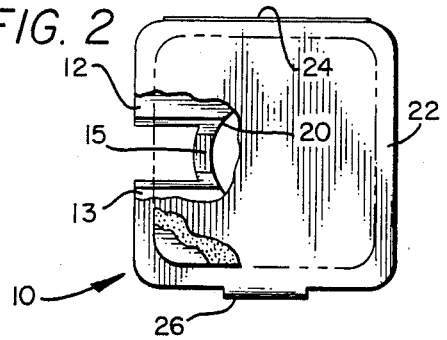
FIG. 2 is a rear elevation view, partially broken away, of the decorative light pedestal shown in FIG. 1.
Figure 3:
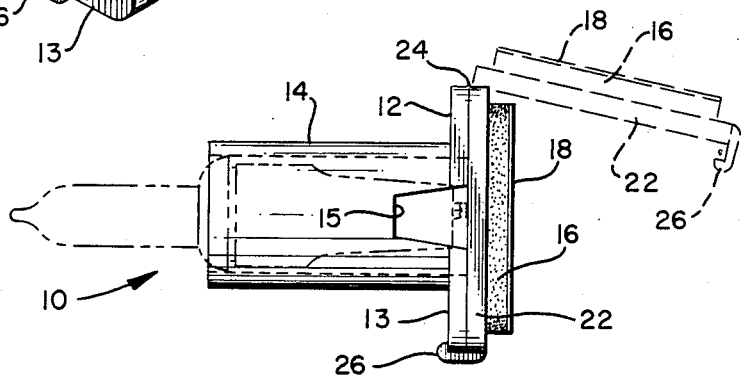
FIG. 3 is a side elevation view of the decorative light pedestal of FIG. 1 with a phantom outline showing an alternate position of the cover member and closure member of the invention when rotated around the hinge connecting the cover member to the base member of the decorative light pedestal, and further showing the socket portion of a conventional mini-light decorative bulb and socket assembly disposed inside the circumferential support member of the subject decorative light pedestal.

Referring to FIGS. 1, 2 and 3, decorative light pedestal 10 preferably comprises base sections 12, 13, circumferential support member 14 and adhesive means 16. A void extending through pedestal 10, including base member 13 and the lower portion of circumferential support member 14, defined by walls 15 on each side thereof (as can also be seen identified by reference numerals 14*a*, 14*b* of FIGS. 1, 2 and 3 of U.S Pat. No. 4,877,209, the specification of which is also incorporated herein by reference). This void is intended to accommodate the passage of wire connected to a decorative bulb and socket assembly as shown in phantom outline in FIG. 3.

Although circumferential support member 14 and bore 20 are depicted herein as being cylindrical, it will be apparent upon reading this disclosure that support members having different cross-sectional shapes can be similarly utilized within the scope of the invention so long as the interior space within the support member is adequate to accommodate the socket, or bulb and socket assembly, as desired. Thus, as used herein, the term "circumferential" refers to the fact that the support member extends radially around the decorative socket, or decorative bulb and socket assembly, as the case may be, and does not imply that the geometry of the support member requires a circular cross-section Also, while the side walls of support member 14 are depicted herein as being continuous, with the exception of the void defined by walls 15, it is understood that the pedestals of the invention can also comprise, for example, a lattice that extends circumferentially around the decorative light socket or bulb and socket assembly.

According to a preferred embodiment of the invention, circumferential support member 14 and base member sections 12, 13 are unitarily molded, such as by injection molding, from a polymeric resin. Acrylic resin is particularly preferred for use in making the subject invention.

Decorative light pedestal 10 preferably further comprises polymeric cover member 22 that is preferably substantially coextensive with the outwardly extending edges of base member sections 12, 13. According to one particularly preferred embodiment of the invention, circumferential support member 14, base member sections 12, 13 and cover member 22 are unitarily molded, such as by injection molding, with living hinge 24 permanently connecting cover member 22 with one of base member sections 12, 13. As shown in FIGS. 1, 2 and 3, hinge 24 connects cover member 22 with base member section 12, and closure member 26 (a molded plastic hook) is disposed opposite ends 24 on cover member 22 to releasably maintain cover member 22 in facing engagement with the rearwardly facing surfaces of base member sections 12, 13 that are opposite circumferential support member 14. According to this preferred structure, a decorative socket assembly as shown in FIG. 3 can be displaced from base member sections 12, 13 by disengaging closure member 26 from base member section 13 and thereafter separating base member section 13 from closure member 22 by rotating them away from each other around hinge 24 to a position as shown in phantom outline in FIG. 3.

According to a preferred embodiment of the invention, cover member 22 further comprises adhesive means 16 for mounting decorative light pedestal 10 on a support surface. Adhesive means preferably comprises a foamed polymeric pad impregnated with an adhesive material having a protective cover sheet 18 disposed on the side opposite cover member 22. In order to mount decorative light pedestal 10 on a support surface, cover sheet 18 is first removed, and cover member 22 is then pressed downward against the support surface. If closure member 26 is attached to base member section 13 at the time of mounting decorative light pedestal 10 on a support surface, mounting is preferably done by exerting manual pressure downward against the outwardly extending surfaces of base member sections 12, 13. If, on the other hand, closure member 26 is disengaged from base member section 13 at the time cover member 22 is adhered to the support surface, pressure is preferably applied directly against cover member 22 to firmly attach adhesive means 16 to the support surface. It will be understood, of course, that once adhesive means 16 has been utilized to attach cover member 22 of decorative light pedestal 10 to an underlying support surface, circumferential support member 14 and base member sections 12, 13 will be rotated away from cover member 22 and hinge 24 to insert a decorative socket into or remove a decorative socket out of bore 20 of the circumferential support member 14 rather than rotating cover member 22 upward away from base member section 13 as shown in FIG. 3.

While adhesive means 16 is, in the preferred embodiment of the invention, an adhesive pad, it is understood that other similarly effective means for adhering cover member 22 to a support surface can also be utilized within the scope of the invention.

According to another embodiment of the invention, cover member 22 is provided with another closure member 26 in lieu of hinge 24 for connecting cover member 22 to base member section 12 of decorative light pedestal 10. According to this embodiment of the invention, decorative bulb and socket assemblies are inserted into and removed from circumferential support member 14 by completely separating base member sections 12, 13 from cover member 13 upon the release of closure member 26 rather than by rotating base member section 12, 13 and circumferential support member 14 away from cover member 22 around hinge 24. Use of this embodiment of the invention may be particularly desirable where one wants to leave the cover member 22 in place on the support surface at all times and merely releasably engage circumferential support member 14 and base member sections 12, 13 to cover member 22 during those times when it is desired to display decorative lighting.

Figure 4:
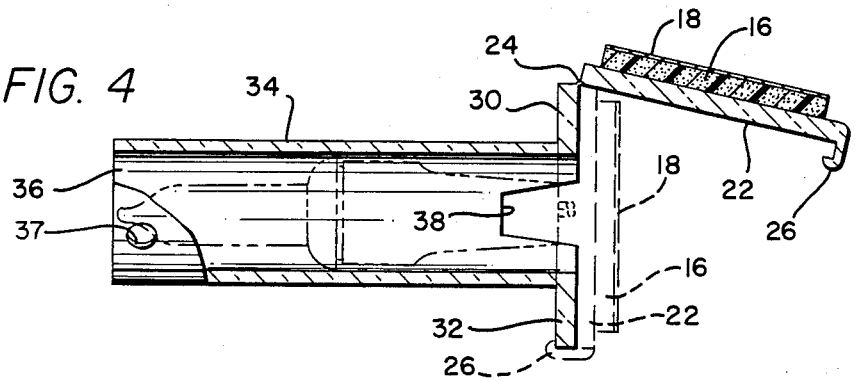
FIG. 4 is a side elevation view, partially in section, representing an alternate embodiment of the decorative light pedestal of the invention wherein the cover member and closure member are rotated away from the base member, and wherein the circumferential support member extends sufficiently outward from the base member that it radially encircles the mini-light decorative bulb and socket assembly disposed therein as shown in phantom outline.

Another embodiment of the invention is shown in FIG. 4, which depicts a circumferential support member 14 extending outwardly from base member sections 30, 32. Base member section 30 is attached to cover member 22 by hinge 24 as previously disclosed in relation to FIGS. 1, 2 and 3 above. Circumferential support member 34 extends outwardly from base member sections 30, 32 sufficiently that bore 36 is at least longitudinally coextensive with the combined length of the conventional mini-light decorative bulb and socket assembly (as shown in phantom outline) disposed therein.

Whenever circumferential socket support member 34 radially encircles the decorative bulb portion of the decorative bulb and socket assembly utilized with the decorative light pedestal, the circumferential support member 34 is preferably molded from a transparent or translucent polymeric material, or else is made with a circumferentially extending latticework or at least one aperture 37 adapted to permit the transmission of light in a direction radially outward therefrom.

Walls 38 defining oppositely disposed notches near the intersection of circumferential support member 34 and base member sections 30, 32 are adapted to accommodate the passage of flexible conductors connected to the socket assembly as previously described in relation to decorative light pedestal 10 of FIGS. 1, 2 and 3. The use of a circumferential support member 34 that is at least longitudinally coextensive with the decorative bulb and socket assembly will afford greater protection to the decorative bulbs utilized in conjunction therewith and will also serve to reduce or eliminate any tampering with the decorative bulb that might otherwise result.

Figure 5:
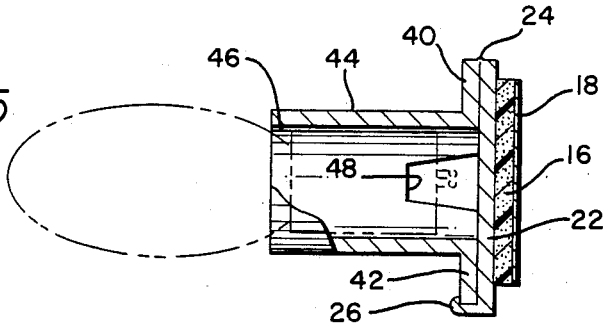
FIG. 5 is a side elevation view, partially in section, of another alternate embodiment of the decorative light pedestal of the invention wherein the cover member is rotated downwardly around the hinge until it is in facing contact with the mounting surfaces of the displaced sections of the base member, with the closure member releasably hooked over the base member, and further showing in phantom outline the socket section of a conventional C7-or C9-size decorative bulb and socket assembly disposed inside the circumferential support member of the decorative light pedestal.

Referring to FIG. 5, another embodiment of the subject decorative light pedestal is disclosed, which comprises base member sections 40, 42, circumferential support member 44 defining bore 46, and notches defined by walls 48 for permitting electrical conductors to extend outwardly from bore 46 whenever cover member 22 is closed as shown in FIG. 5. Cover member 22, as previously described above, is attached to base member section 40 by hinge 24, and closure member 26 releasably engages base member section 40 opposite hinge 24. As shown in FIG. 5, the subject decorative light pedestal was utilized in conjunction with a conventional, commercially available C7-or C9-sized decorative bulb and socket assembly (shown in phantom outline). Whenever the diameter of the decorative bulb is greater than the diameter of bore 46, cover member 22 and base member sections 40, 42, are rotated apart around hinge 24, and the decorative socket assembly is thereafter inserted into bore 46 between base member sections 40, 42. Once the socket assembly is fully inserted, base member section 42 is again rotated into facing engagement with cover member 22, and closure member 26 releasably engages base member 42. The decorative bulb can then be inserted into the decorative light socket, and the electrical conductors extending outwardly through the passageways defined by walls 48 will limit the rotation of the socket assembly within bore 46, thereby permitting the decorative bulb and socket assembly to be brought into full threaded engagement.

Figure 6:
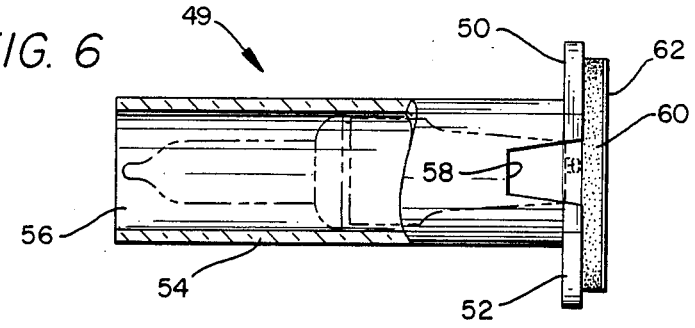
FIG. 6 is a side elevation view, partially in section, of another embodiment of the invention wherein the adhesive means is attached directly to the mounting surface formed on the rearwardly directed faces of the base sections, and wherein the circumferential support member extends outwardly from the base member sufficiently that it is at least coextensive with the conventional mini-light decorative bulb and socket assembly as shown in phantom outline disposed therein.

Referring to FIG. 6, an embodiment of the invention is disclosed in which adhesive means 60 also functions as the cover member adapted for attachment to base member sections 50, 52. Circumferential support member 54 of decorative light pedestal 49 as shown in FIG. 6 further comprises bore 56 that is at least longitudinally coextensive with the combined length of the mini-light decorative bulb and light assembly shown in phantom outline disposed therein. Notches defined by walls 58 oppositely disposed through circumferential support member 14 between base member sections 50, 52 to allow for the outward passage of electrical conductors attached to the socket assembly as previously disclosed. Cover sheet 62 over adhesive means 60 is adapted to be removed prior to mounting decorative light pedestal 49 on a support surface.

Other alterations and modifications of the subject invention will become obvious to those of ordinary skill in the art upon reading this disclose, and it is intended that the present invention be limited only by the broadest interpretation of the appended claims to which the inventor may be legally entitled.

I claim:

1. A decorative light pedestal adapted to receive and maintain at least the socket portion of a decorative bulb and socket assembly, said pedestal comprising a base member having spaced apart sections which cooperate to define a substantially planar surface;

a circumferential socket support member extending outwardly from said base member on the side of said base member that is opposite said substantially planar surface;

a first void extending axially through the circumferential support member and the plane of the base member to permit said socket assembly to be inserted into the circumferential support member through said base member, and a second void adapted to receive and accommodate the passage of wiring connected to said socket assembly through said circumferential support member after said socket assembly is inserted therein; and a cover member joined by a hinge to said base member that is substantially coextensive with the outer perimeter of said base member and releasably engageable with said base member to maintain said decorative socket assembly inside said decorative light pedestal.

2. The decorative light pedestal of claim 1 wherein said cover member is connected to said base member by a hinge at one side thereof and further comprises a releasable closure oppositely disposed from said hinge for releasably securing said cover member to the portion of said base member opposite said hinge.

3. The decorative light pedestal of claim 1 wherein said cover member further comprises means for adhesively securing said cover member to a support surface.

4. The decorative light pedestal of claim 1 wherein said circumferential support member is at least longitudinally coextensive with the overall length of said decorative bulb and socket assembly.

5. The decorative light pedestal of claim 4 wherein said circumferential support member further comprises at least one aperture adapted to facilitate the passage of light radially outward from the bulb portion of said decorative bulb and socket assembly.

6. A decorative light pedestal adapted to receive and maintain a decorative bulb and socket assembly and bond said pedestal to a support surface, said support comprising a base member having a substantially planar mounting surface comprising spaced apart sections which cooperate to define the plane of said mounting surface;

a circumferential socket support member extending outwardly from said base member on the side of said base member that is opposite said mounting surface, said circumferential socket support member being at least longitudinally coextensive with said decorative bulb and socket assembly;

a first void extending axially through the circumferential support member and the plane of the base member to permit said socket assembly to be inserted into the circumferential support member through said base member, and a second void adapted to receive and accommodate the passage of wiring connected to said socket assembly through said circumferential support member after said socket assembly is inserted therein; and adhesive means adapted to bond said mounting surface of said pedestal to said support surface.

7. The decorative light pedestal of claim 6 wherein said circumferential support member further comprises at least one aperture adapted to facilitate the passage of light through that portion of said circumferential support member that is disposed radially outward from the bulb portion of said decorative bulb and socket assembly.

* * * * *

UNITED STATES PATENT AND TRADEMARK OFFICE

CERTIFICATE OF CORRECTION

PATENT NO. : 4,986,504

DATED : January 22, 1991

INVENTOR(S) : Lonnie F. Gary

It is certified that error appears in the above-identified patent and that said Letters Patent is hereby corrected as shown below:

Column 1, Line 8:
delete [1981] and insert --1989--

Column 1, Line 9:
delete [4,998,209] and insert --4,877,209--

Signed and Sealed this

Seventh Day of July, 1992

*Attest:*

*Attesting Officer*

DOUGLAS B. COMER

*Acting Commissioner of Patents and Trademarks*